US009863199B1

(12) United States Patent
Riedel et al.

(10) Patent No.: US 9,863,199 B1
(45) Date of Patent: Jan. 9, 2018

(54) SOIL SAMPLER LAY FLAT SHEET LINER SYSTEM

(71) Applicant: Kejr, Inc., Salina, KS (US)

(72) Inventors: Kyle Riedel, Salina, KS (US); Joel Christy, Brookville, KS (US); Jed Davis, Salina, KS (US)

(73) Assignee: Kejr, Inc., Salina, KS (US)

( * ) Notice: Subject to any disclaimer, the term of this patent is extended or adjusted under 35 U.S.C. 154(b) by 329 days.

(21) Appl. No.: 14/508,830

(22) Filed: Oct. 7, 2014

Related U.S. Application Data

(60) Provisional application No. 61/887,936, filed on Oct. 7, 2013.

(51) Int. Cl.
*E21B 25/06* (2006.01)

(52) U.S. Cl.
CPC ..... *E21B 25/06* (2013.01)

(58) Field of Classification Search
CPC ..... E21B 25/06; E21B 25/00; E21B 25/10; E21B 49/00
See application file for complete search history.

(56) References Cited

U.S. PATENT DOCUMENTS

| | | | | |
|---|---|---|---|---|
| 5,606,139 | A * | 2/1997 | Wittig | E21B 25/00 73/864.44 |
| 6,029,355 | A | 2/2000 | Carlin | |
| 6,302,211 | B1 * | 10/2001 | Nelson | E21B 23/01 166/338 |
| 6,695,075 | B2 | 2/2004 | Beeker | |
| 7,182,155 | B2 | 2/2007 | Lange | |
| 8,459,374 | B1 | 6/2013 | Copping et al. | |
| 2010/0122447 | A1 * | 5/2010 | Peterson | B01D 29/111 29/505 |
| 2010/0248215 | A1 * | 9/2010 | Halverson | G01N 1/38 435/5 |

* cited by examiner

*Primary Examiner* — Caroline N Butcher
(74) *Attorney, Agent, or Firm* — Jeffrey L. Thompson; Thompson & Thompson, P.A.

(57) ABSTRACT

A liner assembly for use in a soil sampling system comprises a thin sheet of flexible plastic that can be laid flat for shipping and rolled into a cylindrical shape with overlapping edges for use as a liner. The rolled sheet can be inserted into a soil sample tube to line the sample tube during soil sampling operations. A wedge assembly comprising a split holding ring and a wedge ring holds the liner in place at the bottom of the soil sample tube. After the soil sampling system is advanced into the subsurface to collect a soil sample, the soil sample is removed by removing the cutting shoe from the sample tube and sliding the rolled liner sheet out the bottom end of the sample tube. The liner sheet can be unrolled to access and remove the soil sample. The liner sheet can be reused after removing the soil sample.

13 Claims, 7 Drawing Sheets

SOIL SAMPLER LAY FLAT SHEET LINER SYSTEM

RELATED APPLICATIONS

This application claims the benefit of U.S. Provisional Patent Application No. 61/887,936 filed on Oct. 7, 2013. The entire content of the priority application is incorporated herein by reference.

BACKGROUND OF THE INVENTION

Field of the Invention

The present invention relates generally to devices for obtaining soil samples from below the surface of the ground. In particular, the present invention relates to soil sampling systems that use liners inside of soil sample tubes.

Description of the Related Art

Methods and practices for collecting representative subsurface soil samples date back many decades. The collection of soil samples is a necessity in some of the following industries: environmental, geotechnical, mineral exploration, and agricultural.

An overview of a conventional soil sampling assembly 10 and its operation procedure will be provided to help define the task of a liner in soil sampling. The basic components of a conventional soil sampling assembly 10 are shown in FIG. 1, and are briefly described below.

A soil sample tube/barrel 11 is typically a cylindrical tube with a threaded connection to a cutting shoe 12 on one end, and a drive head 13 on the other end. The sample tube or barrel 11 provides the space or container that the soil sample occupies once it is collected from the subsurface. It is noteworthy that the cutting shoe 12, sample tube 11, and drive head 13 are usually manufactured with mating threads so that the entire assembly can be assembled and disassembled in the field.

The cutting shoe or bit 12 is a separate component with a cutting surface 14 at the leading edge of the sampler. It is the component responsible for cutting thru the soil as the soil sampler assembly 10 is driven or advanced thru the sample interval. It also protects the sample tube 11 from being damaged during advancement thru the soil sample interval. The cutting shoe or bit 12 is usually considered a consumable part due to the wear of the cutting edge or leading surface. Cutting shoes or bits 12 have several different configurations suited for driving thru a variety of soils ranging from soft soils to very hard rock formations. The cutting surface 14 can utilize many different features, such as sharp cutting edges, cutting teeth, carbide buttons, diamond cutters, and many others.

The drive head or sampler head 13 is a component of the overall soil sampler assembly 10 that allows the sampler to be used with various drill rods, probe rods, center rods, or wire line systems. It serves as an adapter so that a common rod or wire line can be used to lower, drive, and retract the sampler assembly. It is common for the head 13 to have various features, such as check balls, vent holes, and water or air passages.

The soil sampler assembly 10 can also include an optional soil liner 15 that lines the inside of the sample tube 11. The soil liner 15 contains the soil sample and allows for simple removal of the sample from the sample tube 11. Typically, the liner 15 is a thin walled cylindrical tube made out of plastic, stainless steel, brass or aluminum.

The general use and operation procedure for the conventional soil sampling assembly 10 are illustrated in FIGS. 2(*a*) to 2(*d*) and are described as follows:

Soil Sampler Assembly and Advancement into Subsurface (i.e. Soil Sample Collection).

The assembled soil sampler 10 can be connected to a common rod, pipe, or casing, and driven or advanced through the sampling interval (usually 1 meter to 60 inches, but can be shorter or longer). The means for driving or advancing the soil sampler assembly 10 can be percussion, rotation, vibration, static push, or a combination thereof. FIG. 2(*a*) illustrates the soil sampler assembly 10 advanced through the sampling interval and filled with soil.

Soil Sampler Assembly Extraction from the Subsurface or Borehole

Once the soil sampler assembly 10 has been advanced thru the sampling interval, the soil sample has been collected, and the soil sample is occupying the sample tube 11, the soil sampler assembly 10 can be retracted from the borehole B using the connected drill rod, probe rod, or wire line. FIG. 2(*b*) illustrates the open borehole B after the soil sampler assembly 10 has been removed.

Soil Sample Removal from the Soil Sampler Assembly

When the soil sampler assembly 10 is retracted from the borehole B to ground surface, the assembly 10 is disassembled and the soil sample is removed and processed using one of the methods described below. The soil sampler assembly 10 is then reassembled, and the empty soil sampler assembly 10 is reinserted into the bore hole B, as illustrated in FIG. 2(*c*). The soil sampler assembly 10 is then advanced through the next sample interval using a drill rig or probe machine M, as illustrated in FIG. 2(*d*). The process is repeated for deeper sample intervals.

There are a number of methods for obtaining physical access to the actual soil sample inside the soil sampler assembly 10. The methods and practices for accessing the soil sample inside the soil sampler assembly 10 range from careful and tedious to quick and careless. The latter usually causing the most disruption and damage to the soil sample. It is considered good practice to minimize the disruption to the soil sample. Some of the methods and practices for gaining access to the soil sample inside the soil sampler are as follows:

Soil Liner

One common method to gain access to the soil sample relies on the use of a thin walled cylindrical liner 15 inside the soil sampler assembly 10, as mentioned above. In this case, the liner 15 simply slides out of the end of the sample tube 11 once the cutting shoe or bit 12 is removed. The liner 15 can then be cut with a special cutter in order to gain physical access to the soil sample. This method is advantageous due to its efficiency and cleanliness, but it requires a special cutter and adds to the cost of the soil sampler operation.

Vibratory Extraction

In some applications the soil sample is vibrated out of the sample tube 11 using a vibratory oscillator (sonic). This can cause significant disturbance to the soil sampler due to the violent nature of vibrating the soil out of the sample tube 11 and re-collecting it in another containment item, such as a plastic bag or tray. Soil liners are optional for this method, but can be used to reduce soil disturbance.

Hydraulic/Pneumatic Extraction

Another method is hydraulic or pneumatic extraction. This method is less common since it requires the use of compressed water or air to "urge" or pump the soil sample out of the soil sample tube 11. In some cases it is advantageous due to its speed, but it is usually avoided due to the high potential for disturbing and damaging the soil sample. An example of this method is outlined in U.S. Pat. No. 6,695,075.

Split Sample Tube/Barrel

Another method is to use a drivable, split soil sample tube/barrel that can be opened up in order to gain access to the soil sample. This method is advantageous since it minimizes disturbance to the soil sample, and it does not require the use of a soil liner (although soil liners can be used with split samplers). Split soil samplers have been on the market for a number of years, an example of which is disclosed in U.S. Pat. No. 7,182,155.

The use of plastic liners 15 is common for soil sampling, and multiple companies have been selling conventional liners for a number of years. Conventional liners are rigid thin walled cylindrical tubes that are designed to fit inside of a specific sample tube. Conventional liners allow easy removal and storage of the soil sample, and they are typically transparent to allow the soil sample to be easily inspected while still in the liner with minimal disturbance. To access the soil inside of the liner, the liner must be cut open. There are cutters designed specifically for this purpose that allow the liners to be cut much safer than could be done with a simple utility knife (see, e.g., U.S. Pat. No. 6,029,355). However, while the specially designed cutters are safer than a utility knife, they still contain sharp cutting blades and can be a safety hazard. Another problem with conventional liners is cost. Liners are typically used only once, so they are shipped to users in bulk. The rigid tubular shape of conventional liners is inefficient for shipping and adds to the overall liner cost.

U.S. Pat. No. 8,459,374 discloses a liner for a soil sampler that addresses some of the safety hazards associated with cutting conventional liners open to access the soil. The liner disclosed in the '374 patent is pre-scored along its length to allow the liner to be opened with safer tools (i.e., pliers). However, the '374 patent does not address the inefficiencies of the rigid tubular shape of a conventional liner that contributes to increased costs.

There is a need in the industry for an improved liner for soil sampling systems.

SUMMARY OF THE INVENTION

An object of the present invention is to provide an improved liner for soil sampling systems that allows for more efficient handling and access to the soil sample, improved safety, and reduced cost.

The lay flat sheet liner assembly of the present invention comprises a thin sheet of flexible plastic that can be laid flat for shipping and rolled into a cylindrical shape with overlapping edges for use as a liner. The rolled sheet can be inserted into a soil sample tube to line the sample tube during soil sampling operations. A wedge assembly comprising a split holding ring and a wedge ring can be used to hold the liner in place at the bottom of the soil sample tube. After the soil sampling system is advanced into the subsurface to collect a soil sample, the soil sample is removed by removing the cutting shoe from the sample tube and sliding the rolled liner sheet out the bottom end of the sample tube. The liner sheet can then be unrolled to access and remove the soil sample. The liner sheet can be reused multiple times.

According to a broad aspect of the present invention, a liner assembly is provided for a soil sampling system, comprising: a thin sheet of flexible plastic having a first configuration in which the sheet lays flat for shipping and for permitting soil access, and a second configuration in which the sheet is rolled into a cylindrical shaped liner with overlapping edges for lining an inside of a soil sample tube.

According to another broad aspect of the present invention, a soil sampling system is provided, comprising: a cylindrical soil sample tube; a cutting shoe coupled to a bottom end of the sample tube; and a liner assembly. The liner assembly comprises a sheet of flexible material having a first configuration in which the sheet lays flat for shipping and for permitting soil access, and a second configuration in which the sheet is rolled into a cylindrical shaped liner with overlapping edges and positioned inside of the sample tube.

According to another aspect of the present invention, a method of using a soil sampling system, is provided comprising: providing a cylindrical sample tube and a lay flat liner sheet; rolling the liner sheet into a cylindrical shape with overlapping edges; and inserting the rolled liner sheet into the sample tube to line the sample tube.

Numerous other objects of the present invention will be apparent to those skilled in this art from the following description wherein there is shown and described an embodiment of the present invention, simply by way of illustration of one of the modes best suited to carry out the invention. As will be realized, the invention is capable of other different embodiments, and its several details are capable of modification in various obvious aspects without departing from the invention. Accordingly, the drawings and description should be regarded as illustrative in nature and not restrictive.

BRIEF DESCRIPTION OF THE DRAWINGS

The present invention will become more clearly appreciated as the disclosure of the invention is made with reference to the accompanying drawings. In the drawings.

DETAILED DESCRIPTION OF THE INVENTION

A soil sampling system 20 with an improved liner according to the present invention will now be described in detail with reference to FIGS. 3 to 8 of the accompanying drawings.

Figure 1:
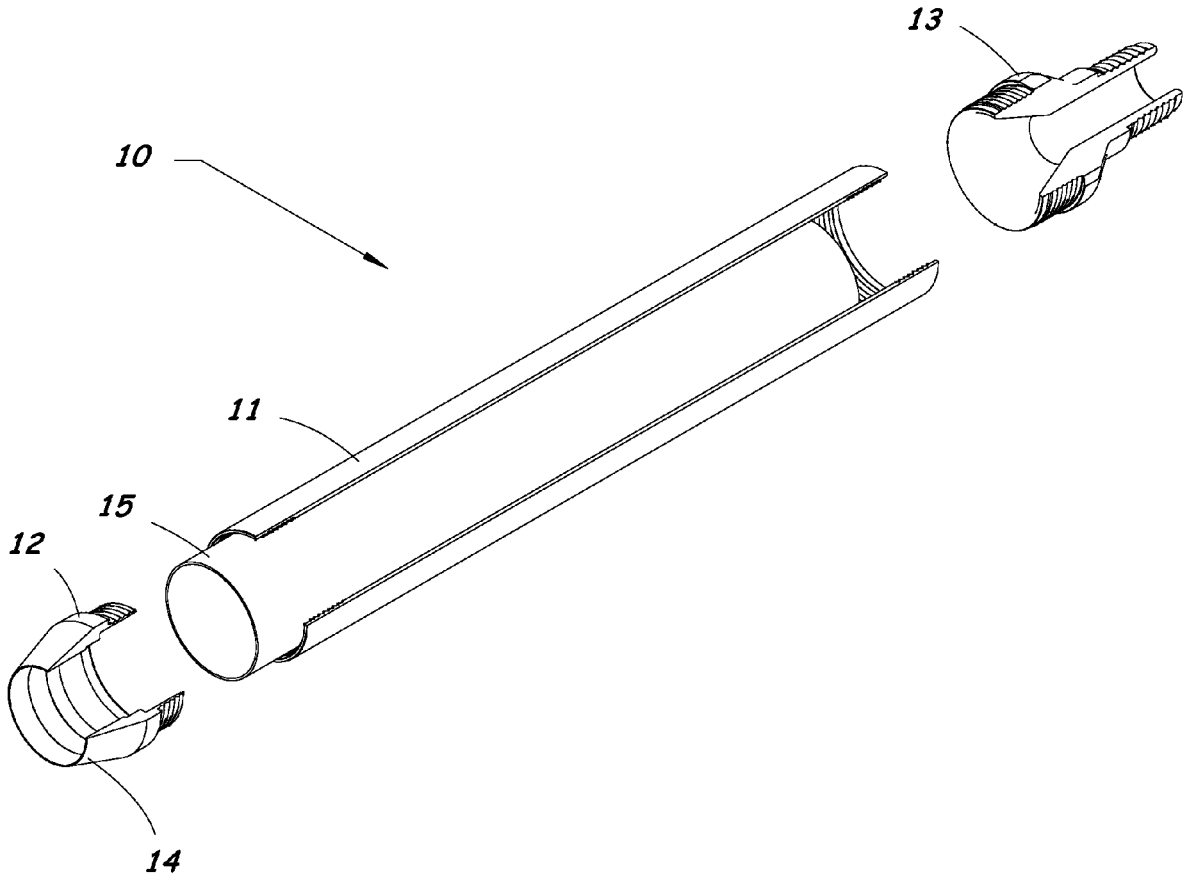
Fig. 1 (Prior Art)
FIG. 1 is a perspective view of a soil sampling system with a conventional liner.
Figure 2:
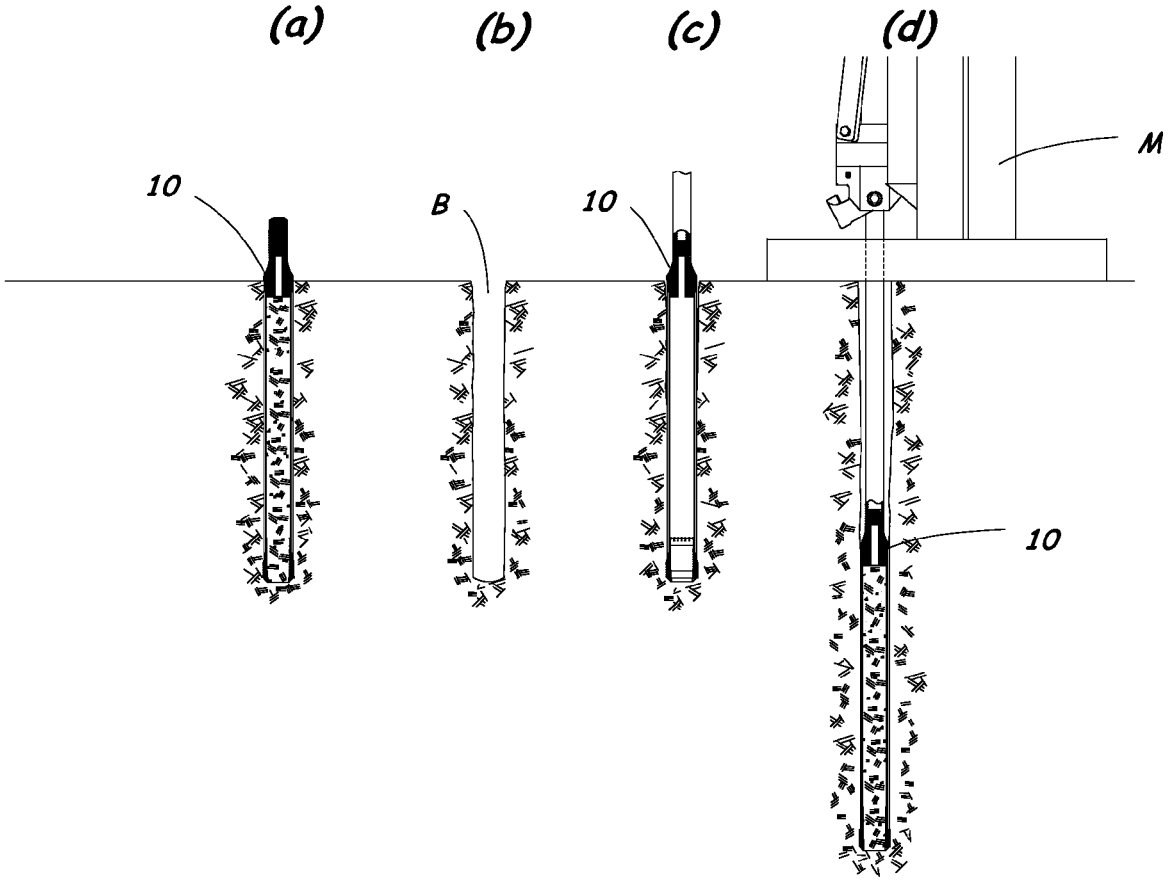
Fig. 2 (Prior Art)
FIGS. 2(*a*) to 2(*d*) illustrate a typical soil sampling operation using the conventional soil sampling system shown in FIG. 1.
Figure 3:
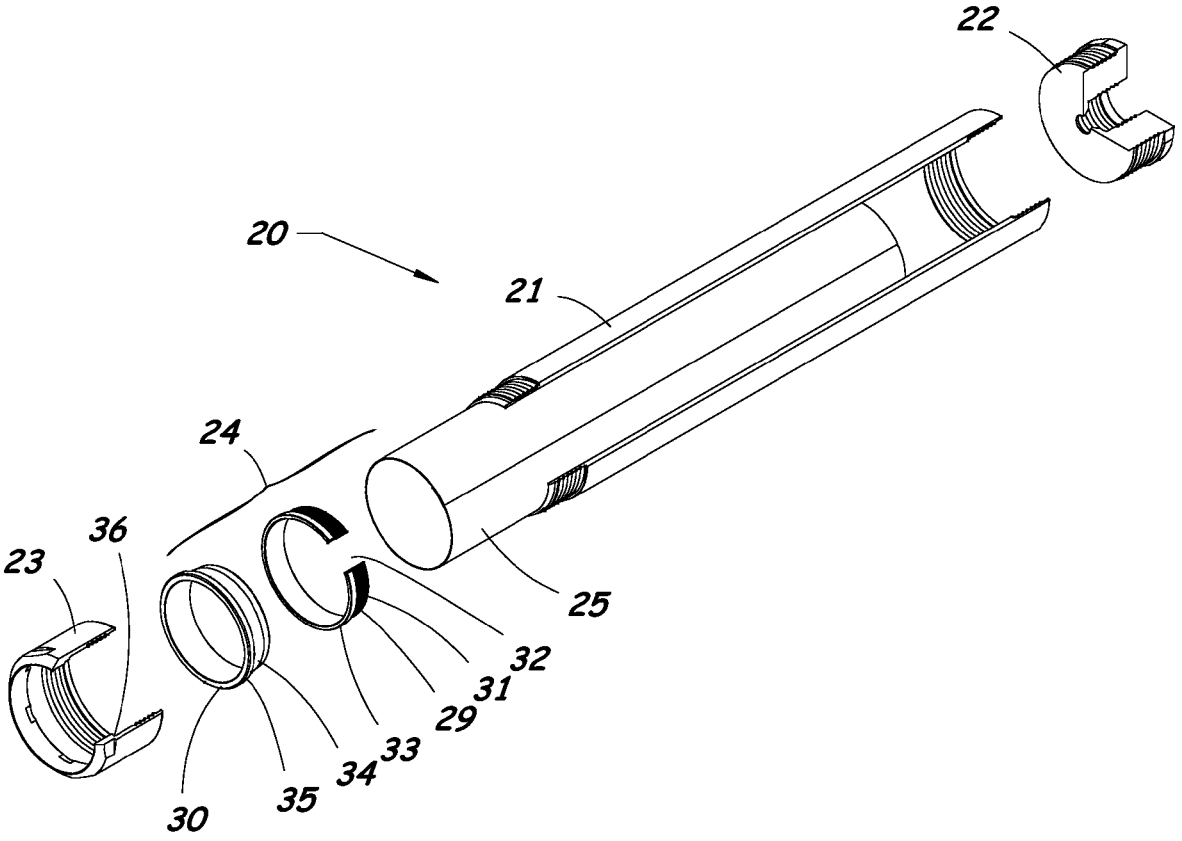
FIG. 3 is a perspective view of a soil sampling system with a lay flat liner assembly of the present invention.

The basic components of the soil sampling system 20 of the present invention are shown in FIG. 3. The soil sampling system 20 includes a cylindrical soil sample tube 21, a drive head 22 attached to the upper end of the sample tube 21, a drive shoe or cutting shoe 23 attached to the bottom end of the sample tube 21, and a liner assembly 24 positioned inside of the sample tube 21. The sampling system 20 can be used in vibratory, percussion, and rotary applications. Other features, such as discreet points and core catchers, can also be used with the sampling system 20.

Figure 4A:
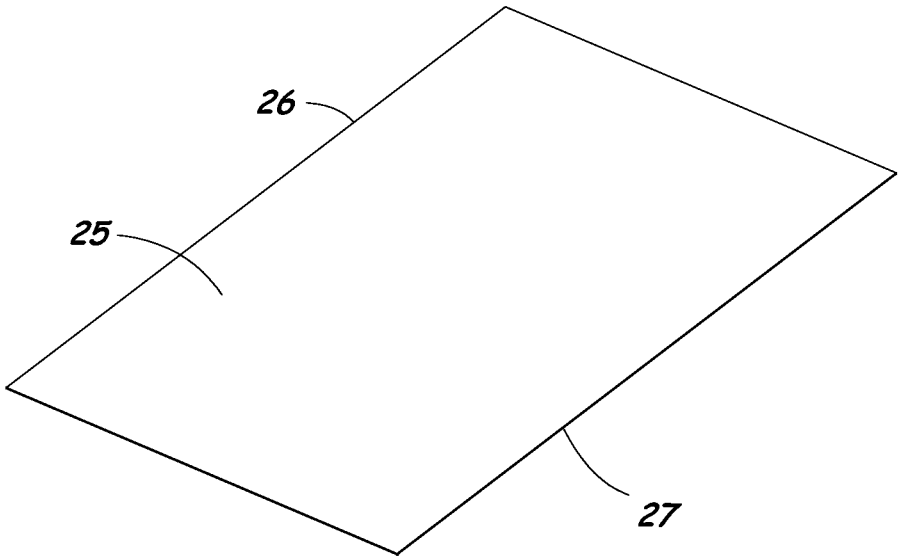
FIGS. 4A and 4B are perspective views of the liner in a flat configuration and a rolled cylindrical configuration, respectively.
Figure 4B:
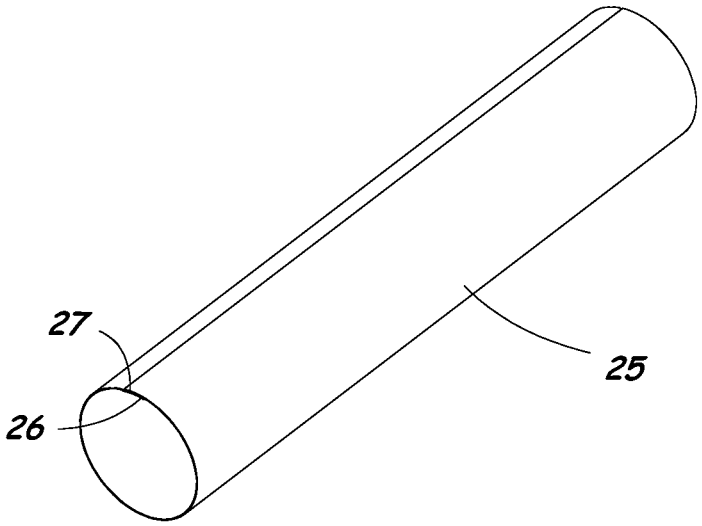
Figure 5:
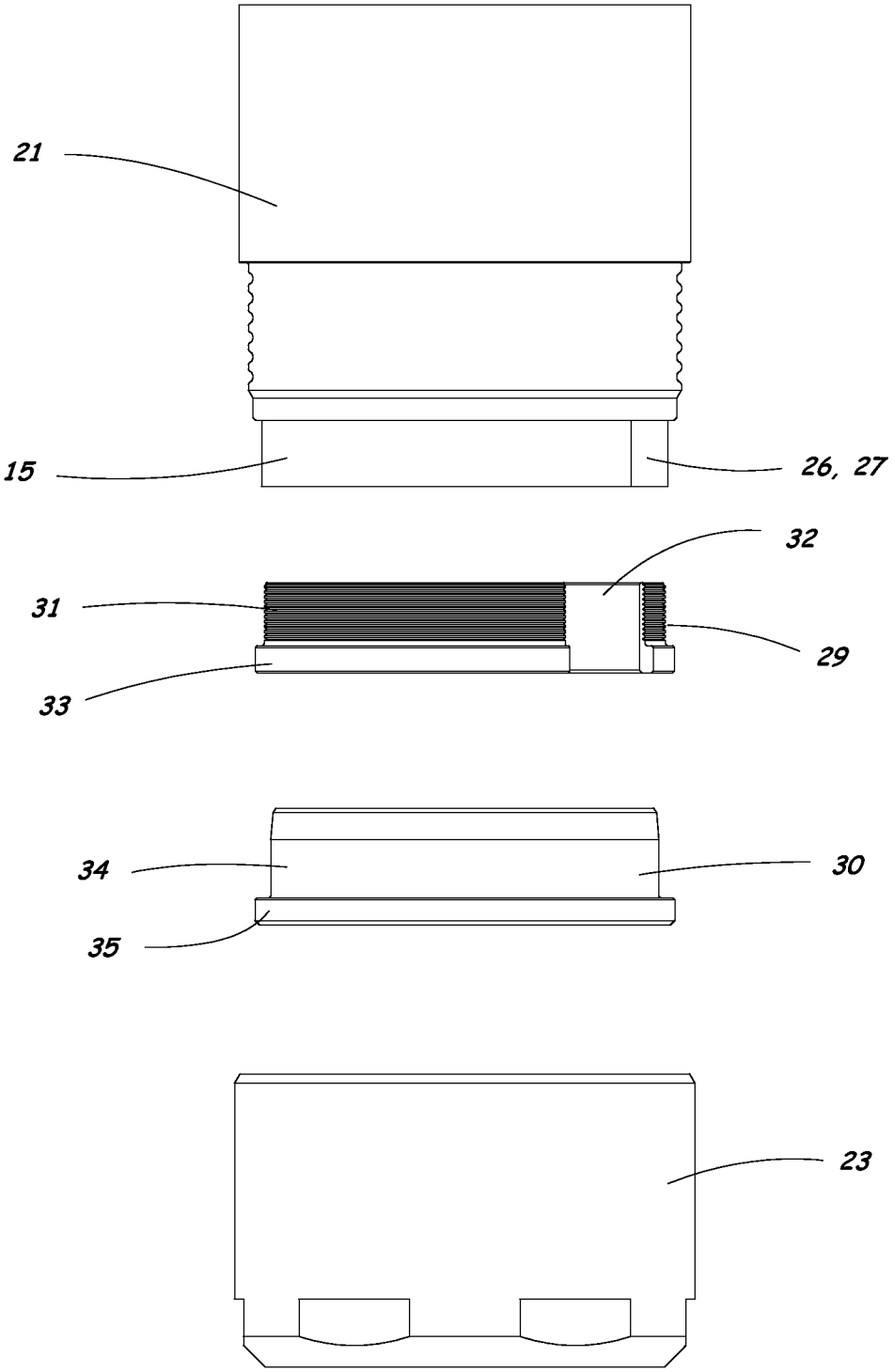
FIG. 5 is an exploded elevation view of the lower end of the soil sampling system with a wedge assembly for holding the liner within the soil sample tube.
Figure 6:
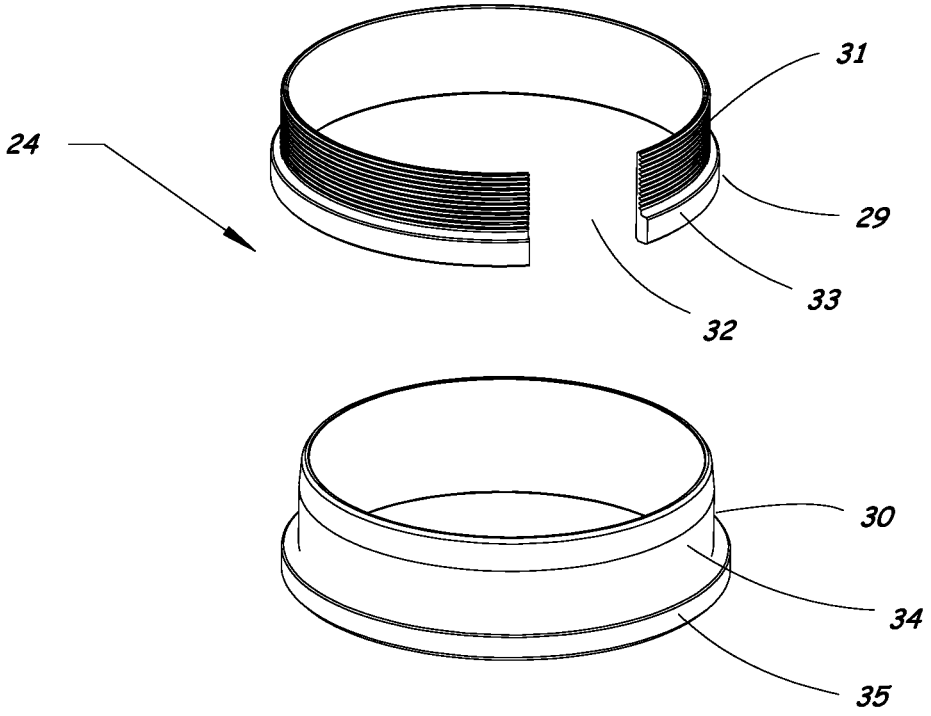
FIG. 6 is a perspective view of the two piece wedge assembly for holding the liner within the soil sample tube.
Figure 7:
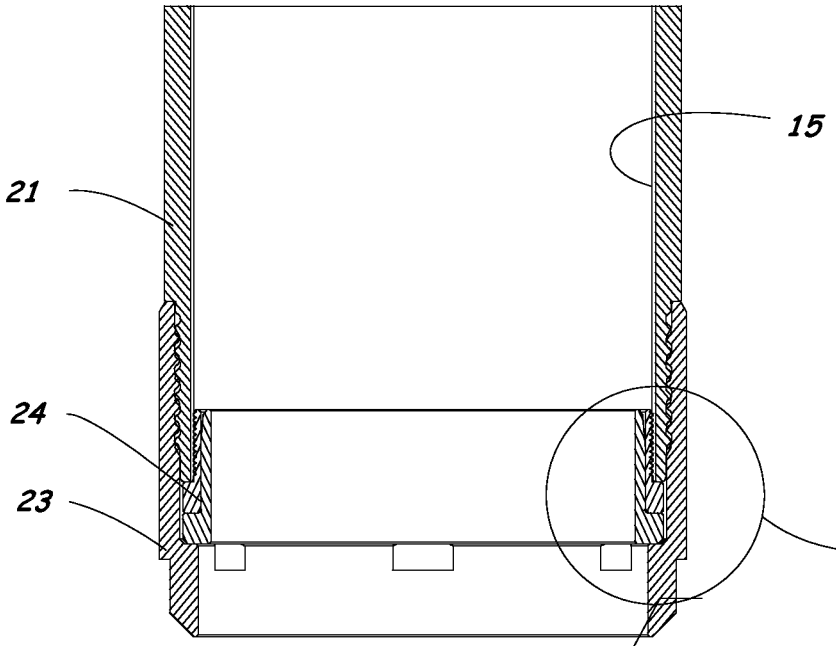
FIG. 7 is a cross section view of the lower end of the soil sampling system.
Figure 8:
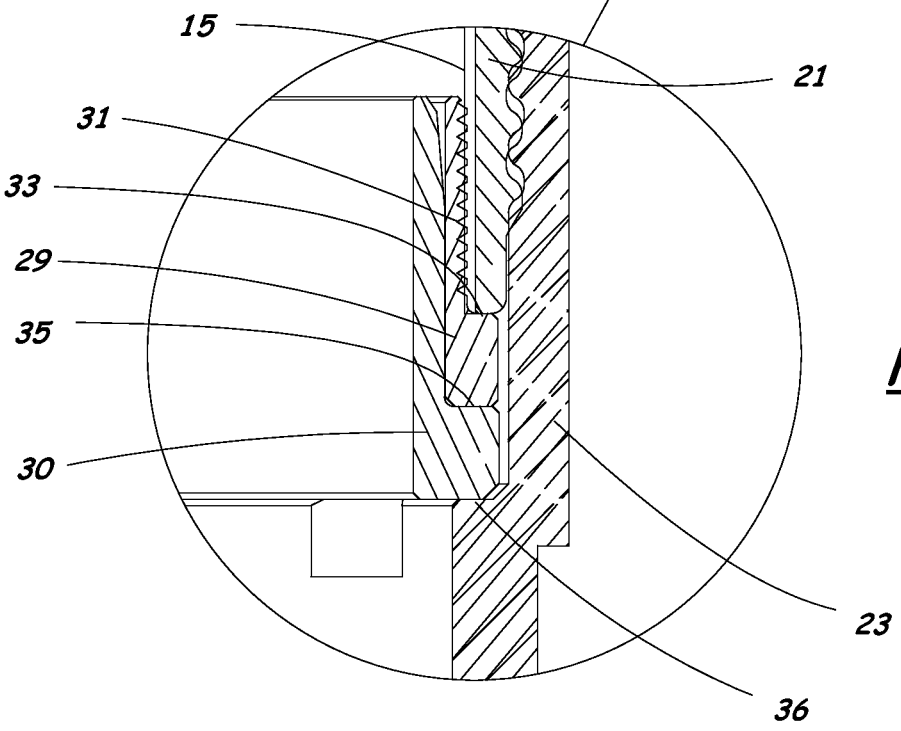
FIG. 8 is a detail cross section view of a portion of the soil sampling system labeled D8 in FIG. 7.

The liner assembly 24 includes a thin sheet 25 of readily recyclable flexible plastic, such as polyethylene. The polyethylene can be, for example, high density polyethylene, low density polyethylene, or ultra high molecular weight polyethylene. The thin plastic sheet 25 has a first flat configuration, as shown in FIG. 4A, and a second rolled configuration, as shown in FIG. 4B. In the first configuration (FIG. 4A), the sheet 25 lays flat for shipping and for permitting access to soil collected by the sampling system 20. The sheet 15 has a generally flat rectangular shape in the first configuration.

In the second configuration (FIG. 4B), the sheet 25 is rolled into a cylindrical shaped liner with overlapping edges 26, 27 for lining the inside of the soil sample tube 21, as shown in FIG. 3. The overlapping edges 26, 27 of the liner 25 allow the liner 25 to be easily opened for access to the soil sample without the use of any tools. Since no cutting or tearing of the liner 25 is required, no sharp material edges are exposed (only factory manufactured edges), thereby improving safety.

The liner assembly 24 also includes a means for holding the liner 25 in place at the bottom end 28 of the soil sample tube 21. The holding means may not be required in every application, but will be useful in some soil formations because the lay flat sheet liner 25 of the present invention has a very low buckling strength (due to the overlapping seam) and will buckle in the presence of too much side friction. The holding means includes a wedge assembly 29, 30 that fits inside the cylindrical shaped liner 25 and presses radially outward to compress the liner 25 against the inside of the soil sample tube 21. The wedge assembly 29, 30 has a split holding ring 29 that presses against the inside of the cylindrical shaped liner 21, and a wedge ring 30 that fits inside the holding ring 29 to press the holding ring 29 radially outward.

The holding ring 29 has a ribbed outer surface 31 that presses against the liner 25. The split 32 in the holding ring 29 facilitates expansion of the holding ring 29 when the wedge ring 30 is forced into engagement with the holding ring 29. An outer lip 33 is formed at the bottom edge of the holding ring 29 for limiting the insertion distance into the cylindrical sample tube 21.

The wedge ring 30 has a tapered outer surface 34 that engages the inside surface of the holding ring 29 to cause the holding ring 29 to expand when the two rings 29, 30 are pressed together. An outer lip 35 is provided at the bottom edge of the wedge ring 30 for limiting the insertion distance into the holding ring 29. The bottom edge of the wedge ring 30 is arranged to engage an internal ledge 36 of the cutting shoe 23.

The cutting shoe 23 is coupled to the soil sample tube 21 by mating the female threads on the cutting shoe 23 with the male threads on the soil sample tube 21. As the cutting shoe 23 is threaded onto the soil sample tube 21, the internal ledge 36 of the cutting shoe 23 engages the bottom edge of the wedge ring 30 to press the wedge ring 30 into engagement with the holding ring 29. The outer lips 33, 35 on the holding ring 29 and the wedge ring 30, respectively, prevent the rings 29, 30 from being inserted too far into the sample tube 21.

In use, the soil sampler assembly 20 is assembled by rolling a flat plastic sheet 25 into a cylindrical shape with overlapping edges, and inserting the rolled plastic sheet 25 into the soil sample tube 21 to line the sample tube 21. The rolled liner sheet 25 is held in place at the bottom end of the sample tube 21 by the wedge assembly 29, 30, which fits inside the rolled liner sheet 25 and presses radially outward to compress the liner 25 against the inside of the sample tube 21. The cutting shoe 23 is then threaded onto the bottom end of the soil sample tube 21.

The soil sampler assembly 20 with the rolled liner sheet 25 contained therein is then advanced into the subsurface through a soil sample interval to collect a soil sample. The assembly 20 is then retracted out of the borehole B and brought to the surface where it can be disassembled. Disassembly of the soil sampler assembly 20 is accomplished by removing the cutting shoe 23 and the wedge assembly 29, 30 from the bottom end of the soil sample tube 21. The rolled liner sheet 25 with the soil sample contained therein can then be slid out the bottom end of the sample tube 21. The liner sheet 25 can be unrolled and laid flat to access and remove the soil sample. Once the soil sample has been removed from the liner sheet 25, the liner sheet 25 can be reused by rolling it into its cylindrical configuration with overlapping side edges 26, 27 and reinserting the rolled sheet 25 into the soil sample tube 21 for use in collecting the next soil sample.

The soil sample liner 25 of the present invention is more efficient than the conventional rigid thin walled cylindrical liner. The liner 25 of the present invention is rolled into a cylindrical shape to line the sampler, but when not in use it lays flat. The flat shape is easier to manufacture, and the liners 25 can be densely stacked to increase storage, shipping and handling efficiency, which contributes to cost reduction.

The overlapping edges 26, 27 form a seam that allows easy soil access and also allows for easy soil removal. Since soil can be easily removed, the lay flat liner 25 can be reused multiple times. This reduces sampling costs compared to conventional plastic liners, which are not reusable.

It will be appreciated that certain features of the present invention described above can be changed without departing from the scope of the invention. For example, the liner assembly 24 described herein can be used with a wide range of soil sampler diameters and lengths. For another example, the sample tube 21 can be either a solid cylindrical tube (as illustrated herein), or it can be a split sample tube, as disclosed in Applicant's Application No. 61/780,100 titled "Split Tube Soil Sampling System." For another example, the inner surface of the holding ring 29 can be tapered and the outer surface of the wedge ring 30 can be straight to provide a wedge action when the rings 29, 30 are pressed together. Other means for holding the liner 25 in place at the bottom of the soil sample tube 21 can also be used, such as adhesive, retaining ring, and so forth.

While the invention has been specifically described in connection with specific embodiments thereof, it is to be understood that this is by way of illustration and not of limitation, and the scope of the appended claims should be construed as broadly as the prior art will permit.

What is claimed is:

1. A liner assembly for a soil sampling system, comprising:

a thin sheet of flexible plastic having a first configuration in which the sheet lays flat for shipping and for permitting soil access, and a second configuration in which the sheet is rolled into a cylindrical shaped liner with overlapping edges for lining an inside of a soil sample tube, said sheet being changeable from said first configuration to said second configuration for lining the inside of the sample tube and back to said first configuration for permitting access and removal of soil without cutting or tearing said sheet, thereby allowing said sheet to be used and reused multiple times; and a means for holding the cylindrical shaped liner in place at a bottom end of the soil sample tube without permanently attaching the overlapping edges together, wherein said means for holding comprises a wedge assembly that fits inside the cylindrical shaped liner without being permanently attached to the liner and presses radially outward to compress a lower end of the cylindrical shaped liner against the inside of the soil sample tube to maintain the cylindrical shaped liner in a cylindrical shape within said soil sample tube while collecting soil, and wherein said wedge assembly is removable from the cylindrical shaped liner after collecting soil to allow the sheet to be removed from the soil sample tube and changed from said second configuration back to said first configuration.

2. The liner assembly according to claim 1, wherein said flexible plastic is polyethylene.

3. The liner assembly according to claim 2, wherein said polyethylene is a material selected from the group consisting of: high density polyethylene, low density polyethylene, and ultra high molecular weight polyethylene.

4. The liner assembly according to claim 1, wherein said wedge assembly comprises a split holding ring having a gap in a circumference of the ring that allows an outer diameter of the ring to be expanded to press against the inside of the cylindrical shaped liner, and a wedge ring that fits inside the split holding ring to press the split holding ring radially outward against the inside of the cylindrical shaped liner.

5. The liner assembly according to claim 1, wherein said sheet has a flat rectangular shape in said first configuration.

6. A soil sampling system comprising:

a cylindrical soil sample tube;

a cutting shoe coupled to a bottom end of said soil sample tube;

a liner assembly comprising a sheet of flexible material having a first configuration in which the sheet lays flat for shipping and for permitting soil access, and a second configuration in which the sheet is rolled into a cylindrical shaped liner with overlapping edges and positioned inside of said soil sample tube, said sheet being changeable from said first configuration to said second configuration for lining the inside of the sample tube and back to said first configuration for permitting access and removal of soil without cutting or tearing said sheet, thereby allowing said sheet to be used and reused multiple times; and a means for holding the cylindrical shaped liner in place at the bottom end of the soil sample tube without permanently attaching the overlapping edges together, wherein said means for holding comprises a wedge assembly that fits inside the cylindrical shaped liner without being permanently attached to the liner and presses radially outward to compress a lower end of the cylindrical shaped liner against an inside surface of the soil sample tube to maintain the cylindrical shaped liner in a cylindrical shape within said soil sample tube while collecting soil, and wherein said wedge assembly is removable from the cylindrical shaped liner after collecting soil to allow the sheet to be removed from the soil sample tube and changed from said second configuration back to said first configuration.

7. The soil sampling system according to claim 6, wherein said wedge assembly comprises a split holding ring having a gap in a circumference of the ring that allows an outer diameter of the ring to be expanded to press against the inside of the cylindrical shaped liner, and a wedge ring that fits inside the split holding ring to press the split holding ring radially outward against the inside of the cylindrical shaped liner.

8. The soil sampling system according to claim 7, wherein said split holding ring comprises a ribbed outer surface that presses against the cylindrical shaped liner.

9. The soil sampling system according to claim 6, wherein said sheet has a flat rectangular shape in said first configuration.

10. The soil sampling system according to claim 6, further comprising a drive head coupled to an upper end of the soil sample tube.

11. A soil sampling system comprising:

a cylindrical soil sample tube;

a cutting shoe coupled to a bottom end of said soil sample tube;

a liner assembly comprising a sheet of flexible material having a first configuration in which the sheet lays flat for shipping and for permitting soil access, and a second configuration in which the sheet is rolled into a cylindrical shaped liner with overlapping edges and positioned inside of said soil sample tube; and a means for holding the cylindrical shaped liner in place at the bottom end of the soil sample tube, wherein said means for holding comprises a wedge assembly that fits inside the cylindrical shaped liner and presses radially outward to compress the cylindrical shaped liner against an inside surface of the soil sample tube;

wherein said wedge assembly comprises a split holding ring that presses against the cylindrical shaped liner, and a wedge ring that fits inside the split holding ring to press the split holding ring radially outward; and wherein said wedge ring is separate from said cutting shoe, and wherein said cutting shoe comprises an internal ledge arranged to engage a bottom edge of said wedge ring to press said wedge ring into engagement with said split holding ring when the cutting shoe is coupled to said soil sample tube.

12. A method of using a soil sampling system, comprising:

providing a cylindrical sample tube and a lay flat liner sheet;

rolling said liner sheet into a cylindrical shape with overlapping edges that are not permanently attached together;

inserting the rolled liner sheet into said sample tube to line said sample tube; and holding the rolled liner sheet in place at a bottom end of the sample tube using a device that fits inside the rolled liner sheet without being permanently attached to said rolled liner sheet and presses radially outward to compress a lower portion of the rolled liner sheet against the inside of said sample tube;

attaching a cutting shoe to the bottom end of the sample tube after the rolled liner sheet is inserted into the sample tube; and advancing the soil sampling system into the subsurface;

extracting the sampling system from the subsurface; and removing a first soil sample from the sampling system by removing the cutting shoe from the sample tube, sliding the rolled liner sheet out an end of the sample tube, and unrolling the rolled liner sheet into a flat configuration to access the first soil sample contained therewithin.

13. The method according to claim 12, further comprising reusing the liner sheet to collect a second soil sample after removing the first soil sample, said reusing comprising: rolling the same liner sheet into a cylindrical shape with overlapping edges that are not permanently attached together, inserting the rolled liner sheet into said sample tube to line said sample tube, holding the rolled liner sheet in place at the bottom end of the sample tube, advancing the soil sampling system into the subsurface, extracting the sampling system from the subsurface, and removing the second soil sample from the sampling system by unrolling the rolled liner sheet into a flat configuration to access the second soil sample contained therewithin.

* * * * *